US010174553B2

(12) United States Patent
Mugnier

(10) Patent No.: US 10,174,553 B2
(45) Date of Patent: Jan. 8, 2019

(54) METHOD FOR CONTROLLING A WINDING ACTUATOR, WINDING ACTUATOR CONFIGURED FOR SUCH A METHOD, AND CLOSURE OR SUN-SHADING APPARATUS INCLUDING SUCH AN ACTUATOR

(71) Applicant: SOMFY SAS, Cluses (FR)

(72) Inventor: David Mugnier, Mont-Saxonnex (FR)

(73) Assignee: SOMFY SAS, Cluses (FR)

( * ) Notice: Subject to any disclaimer, the term of this patent is extended or adjusted under 35 U.S.C. 154(b) by 0 days.

(21) Appl. No.: 15/328,528

(22) PCT Filed: Jul. 23, 2015

(86) PCT No.: PCT/EP2015/066937
§ 371 (c)(1),
(2) Date: Jan. 24, 2017

(87) PCT Pub. No.: WO2016/012565
PCT Pub. Date: Jan. 28, 2016

(65) Prior Publication Data

US 2017/0211326 A1 Jul. 27, 2017

(30) Foreign Application Priority Data

Jul. 25, 2014 (FR) ..... 14 57211

(51) Int. Cl.
*E06B 9/82* (2006.01)
*E06B 9/17* (2006.01)
(Continued)

(52) U.S. Cl.
CPC ..... *E06B 9/82* (2013.01); *E06B 9/15* (2013.01); *E06B 9/17* (2013.01); *E06B 9/72* (2013.01);
(Continued)

(58) Field of Classification Search
CPC ..... E05F 15/668; E05F 15/41; E05F 15/40; E05F 15/603; E05F 15/70; E05F 15/77;
(Continued)

(56) References Cited

U.S. PATENT DOCUMENTS 5,399,950 A * 3/1995 Lu ..... H02H 7/0851 318/434
5,495,918 A * 3/1996 Peruggi ..... B66B 13/143 187/289
(Continued)

FOREIGN PATENT DOCUMENTS

CN 1104289 A 6/1995
CN 1664296 A 9/2005
(Continued)

OTHER PUBLICATIONS

International Search Report, dated Oct. 13, 2015, from corresponding PCT application.

*Primary Examiner* — Jorge L Carrasquillo
(74) *Attorney, Agent, or Firm* — Young & Thompson

(57) ABSTRACT

The disclosed method enables control of an actuator for winding a blackout screen around a winding shaft. The actuator includes at least one electric motor. The method includes: at least one step that involves using an electronic unit to detect screen locking, during lowering or raising, by detecting a torque exerted by the motor on the winding shaft, the torque being determined on the basis of a current for supplying power to the motor; and a step that involves stopping the motor when a signal representing the detected current is greater than a threshold value. The electronic unit is parametrizable. Moreover, the method includes at least one additional step, used when the signal representing the detected current is less than the threshold value and involving detecting, on the basis of the detected current, a localized
(Continued)

Figure 1:
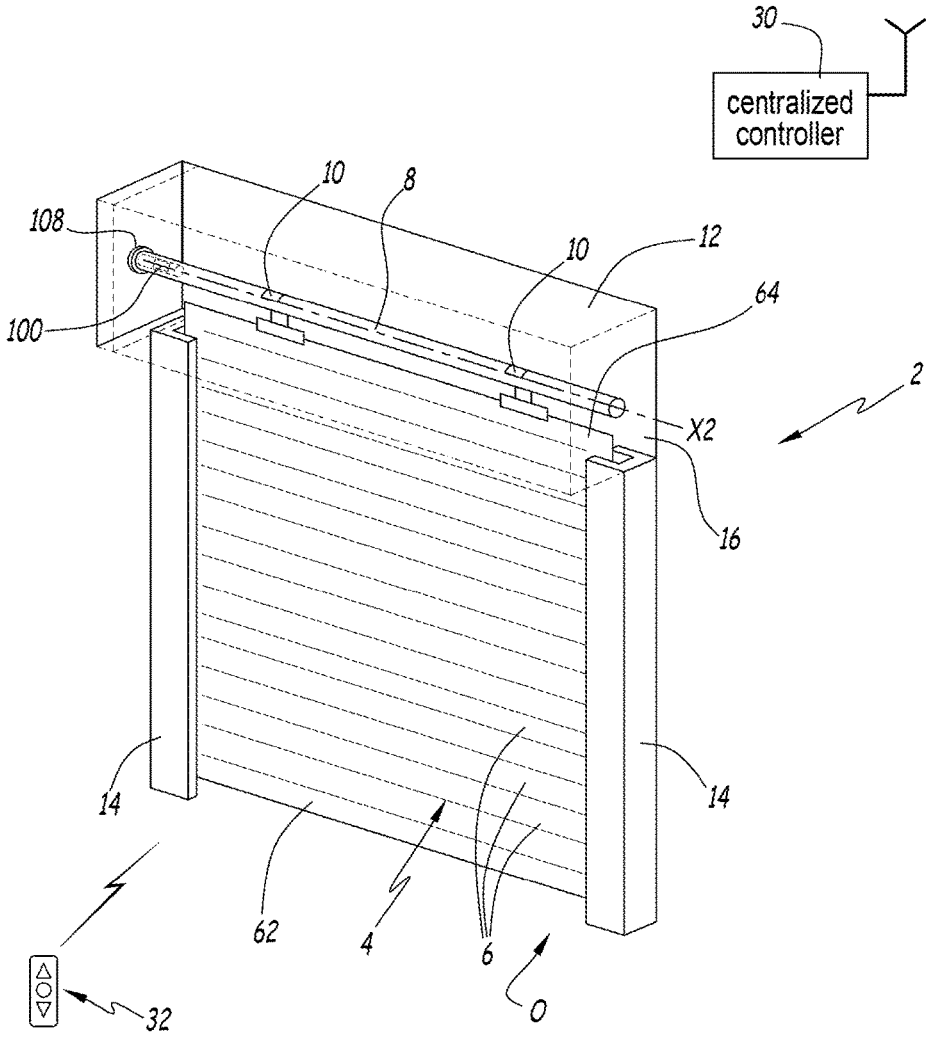

change in the shape of the screen, during lowering, by using the same electronic unit.

13 Claims, 4 Drawing Sheets

(51) Int. Cl.
*E06B 9/72* (2006.01)
*E06B 9/90* (2006.01)
*E06B 9/15* (2006.01)
*E06B 9/68* (2006.01)

(52) U.S. Cl.
CPC ..... *E06B 9/90* (2013.01); *E06B 2009/6809* (2013.01)

(58) Field of Classification Search
CPC ..... E05F 15/00; E05F 15/60; E05F 15/684; E05F 15/695; E05F 15/79; E06B 9/68; E06B 2009/6872; E06B 2009/6845; E06B 9/03
USPC ..... 318/430
See application file for complete search history.

(56) References Cited

U.S. PATENT DOCUMENTS 5,539,290 A * 7/1996 Lu ..... H02H 7/0851 318/434
5,770,934 A * 6/1998 Theile ..... H02H 7/0851 318/466
5,848,634 A * 12/1998 Will ..... E06B 9/174 160/1
5,850,131 A * 12/1998 Wolfer ..... E06B 9/88 318/430
6,005,361 A * 12/1999 Grinewitschus ..... H02H 7/0851 318/430
6,100,659 A * 8/2000 Will ..... E06B 9/174 160/1
6,150,785 A * 11/2000 Butscher ..... H02H 7/0851 318/282
6,201,364 B1 * 3/2001 Will ..... E06B 9/174 160/1
6,259,221 B1 * 7/2001 Yutkowitz ..... G05B 13/042 318/561
6,497,267 B1 * 12/2002 Azar ..... E06B 9/42 160/188
6,646,399 B2 * 11/2003 Kitamura ..... E06B 9/68 318/256
6,741,052 B2 * 5/2004 Fitzgibbon ..... E05F 15/668 318/266
6,864,654 B1 * 3/2005 Letor ..... H02H 7/0851 318/432
6,995,533 B2 * 2/2006 Fitzgibbon ..... E05F 15/41 318/266
7,061,197 B1 * 6/2006 Mullet ..... E05F 15/668 318/466
7,205,735 B2 * 4/2007 Keller ..... E05F 15/40 318/266
7,242,162 B2 * 7/2007 Goth ..... E04F 10/0659 160/7
7,282,883 B2 * 10/2007 Mullet ..... E05F 15/668 318/565
7,294,981 B2 * 11/2007 Marty ..... E06B 9/68 318/139
7,358,480 B2 * 4/2008 Mullet ..... E05F 15/668 250/231.13
7,432,676 B2 * 10/2008 Keller ..... E05F 15/40 318/266
7,445,035 B2 * 11/2008 Bruno ..... E06B 9/80 160/310
7,521,881 B2 * 4/2009 VanDrunen ..... G05B 19/416 318/266
7,719,215 B2 * 5/2010 Meewis ..... E06B 9/322 160/84.02
7,737,653 B2 * 6/2010 Carmen, Jr. ..... E06B 9/68 160/238
7,839,109 B2 * 11/2010 Carmen, Jr. ..... E06B 9/68 318/466
7,923,948 B2 * 4/2011 Rodas ..... E06B 9/322 318/266
8,008,883 B2 * 8/2011 Hoff ..... E04F 10/0651 160/7
8,125,167 B1 * 2/2012 Mullet ..... E05F 15/70 318/265
8,281,795 B2 * 10/2012 Cutler ..... A01G 9/227 135/117
8,950,461 B2 * 2/2015 Adams ..... E06B 9/32 160/1
2001/0000294 A1 * 4/2001 Kitamura ..... E06B 9/68 318/445
2002/0074960 A1 * 6/2002 Schlecht ..... G05B 19/4062 318/445
2003/0193304 A1 * 10/2003 Fitzgibbon ..... E05F 15/668 318/282
2004/0212335 A1 * 10/2004 Fitzgibbon ..... E05F 15/41 318/434
2005/0067987 A1 * 3/2005 Nakazawa ..... H02H 7/0851 318/434
2005/0083004 A1 * 4/2005 Yamamoto ..... H02H 7/0851 318/452
2005/0156546 A1 * 7/2005 Keller ..... E05F 15/40 318/280
2006/0138982 A1 * 6/2006 Marty ..... E06B 9/68 388/809
2006/0290307 A1 * 12/2006 Mullet ..... E05F 15/668 318/466
2007/0075655 A1 * 4/2007 VanDrunen ..... G05B 19/416 318/66
2007/0194218 A1 * 8/2007 Mullet ..... E05F 15/668 250/231.13
2008/0047673 A1 * 2/2008 Meewis ..... E06B 9/322 160/84.02
2008/0224642 A1 * 9/2008 Rodriguez ..... E05F 15/668 318/466
2008/0258666 A1 * 10/2008 Carmen ..... E06B 9/68 318/470
2008/0260363 A1 * 10/2008 Carmen ..... E06B 9/68 388/811
2009/0115366 A1 * 5/2009 Mullet ..... E05F 15/668 318/466
2009/0165779 A1 * 7/2009 Hoff ..... E04F 10/0651 126/572
2009/0173456 A1 * 7/2009 Rodas ..... E06B 9/322 160/168.1 P
2010/0107498 A1 * 5/2010 Ley ..... E05F 15/70 49/199
2010/0117578 A1 * 5/2010 Hollenbeck ..... E05F 15/668 318/461
2010/0126543 A1 * 5/2010 Cutler ..... A01G 9/227 135/117
2012/0261078 A1 * 10/2012 Adams ..... E06B 9/32 160/6
2013/0037068 A1 * 2/2013 Cutler ..... A01G 9/227 135/117
2015/0211281 A1 * 7/2015 Krupke ..... E05D 15/0652 49/506
2016/0362932 A1 * 12/2016 Blair ..... E06B 9/68
2017/0112316 A1 * 4/2017 Rivera ..... A47H 5/02

FOREIGN PATENT DOCUMENTS

CN 1891969 A 1/2007
EP 2 746 526 A1 6/2014
GB 2 387 046 A 10/2003

* cited by examiner

METHOD FOR CONTROLLING A WINDING ACTUATOR, WINDING ACTUATOR CONFIGURED FOR SUCH A METHOD, AND CLOSURE OR SUN-SHADING APPARATUS INCLUDING SUCH AN ACTUATOR

The invention relates to a method for controlling a winding actuator of a blackout screen around a shaft. The invention also relates to a winding actuator for such a screen, this actuator being configured to carry out such a method. Lastly, the invention relates to a closure or sun-shading installation comprising such an actuator.

In the field of closure or sun-shading devices, it is known to maneuver a blackout screen for an opening between an open configuration, in which it is wound around a winding shaft, generally inside a box located above the opening, and a closed position where it extends vertically in the opening, below the winding shaft. In this type of device, it is known to detect an obstacle that opposes the lowering of the screen, i.e., its movement from its first configuration to its second configuration, by detecting a torque supplied by an electric motor belonging to the actuator, owing to the monitoring of a power supply current of this motor. According to a so-called stop detection function, it is known to equip a winding actuator for a rolling shutter of a device that reacts when the screen is blocked on an obstacle, to the point that it is compressed by the motor, which must exert an additional torque, this torque being detected by the device in question.

It is desirable to be able to anticipate such a blocking situation by reacting in advance, once the screen encounters an obstacle, and before it blocks the rotation of the winding shaft driven by the actuator. To that end, it is possible to equip the head of an actuator with an accelerometer or to use an obstacle generating device, as known from EP-A-2 746 526. Other electromechanical devices used for this purpose are based on relative movements between certain component parts of the actuator or the use of force sensors or contactors. These mechanical or mechatronic solutions are precise, but have the drawback of making the configuration more complex, or even impossible, based on the installation in which the actuator must be integrated. Thus, it is not possible to take into account the weight or size of the screen, the diameter of the winding shaft, or the usage conditions on the implementation site of the installation. However, these usage conditions, in particular the quality of the slides guiding the screen, which can be clean and correctly mounted in a new building or have hard spots and alignment defects as part of a renovation, may have a major influence on the movement possibilities of the screen. In the known electromechanical or mechanical materials, the adaptations to the usage conditions are therefore limited and it is only possible to take actual usage conditions of the actuator into account with difficulty. Furthermore, poor adaptation to the usage conditions causes risks of untimely stops of the movement of the shutter, which are bothersome in the use of the shutter on a daily basis.

Furthermore, a certain number of actuators are equipped with a spring-operated brake that has the advantage of effectively accompanying the movements of the winding shaft, when the latter is driving relative to the screen. However, the use of such a spring-operated brake conceals the torque generated by the weight of the screen upon lowering, which limits the performance of a technical solution based solely on measuring the torque delivered by the motor of the actuator.

The invention more particularly aims to resolve these drawbacks by proposing a new method for controlling an actuator for winding a blackout screen that makes it possible to take into account actual usage conditions of the actuator, with a particularly attractive cost, and which is not hindered by the use of a brake, in particular of the spring-operated or cam-operated type.

To that end, the invention relates to a method for controlling an actuator for winding a blackout screen around a winding shaft, this actuator comprising at least one electric motor, the method including at least steps a1 and a2 consisting on the one hand of using electronic means to detect blocking of the screen, during the lowering or raising, by detecting a torque exerted by the motor on the winding shaft, this torque being determined on the basis of a current detected for supplying power to the motor, and on the other hand of stopping the motor when a signal representing the detected current is greater than a threshold current value. According to the invention, the electronic means are parameterizable, and this method comprises an additional step b, implemented when the signal representative of the detected current is below the threshold current value, consisting of detecting a localized deformation of the screen, during lowering, by using the same electronic means and based on the detected current.

Owing to the invention, the early detection of an obstacle obtained in step b resolves the same issues as the mechanical or mechatronic solutions of the prior art, while having the flexibility of a software solution. Step b supplements steps a1, a2 and allows a finer detection, before the motor of the actuator exerts force, via the screen, on stops or any obstacles. Since the electronic means used in step b are parameterizable, the detection level used in this step can be adjusted based on actual usage conditions of the actuator in a closure or sun-shading installation, in particular taking into account the size and weight of the screen, the diameter of the winding shaft and the environment of the actuator, in particular, the quality of the slides guiding the screen.

According to advantageous but optional aspects of the invention, such a method may incorporate one or more of the following features, considered in any technically allowable combination:

- Step b comprises at least elementary steps b1 to b4 consisting of:
  - b1) creating a first digital signal, by applying first digital processing to a signal representative of the power supply current of the motor,
  - b2) creating a second digital signal by applying at least one second digital processing operation to the first digital signal,
  - b3) comparing the first digital signal to the second digital signal,
  - b4) establishing whether blocking of the screen is imminent, based on the result of the comparison of elementary step b3.
- The second digital signal is created by applying value shift processing to the first digital signal, in addition to the second digital processing operation.
- The first digital processing operation and the second digital processing operation are of the same nature.
- The first digital processing operation and/or the second digital processing operation comprise the application of a low-pass filter.
- The signal representative of the current is an image of an instantaneous value of this current and, during elementary step b4, blocking of the screen is considered to be imminent when the first digital signal is greater than the second digital signal.

The signal representative of the current is an image of an instantaneous value of this current and, during elementary step b4, blocking of the screen is considered to be imminent when the difference between the first digital signal and the second digital signal is above a predefined threshold.

The method comprises a prior step c for parameterizing the electronic means, based on a determined sensitivity level, in particular selected, for detecting the imminent blocking of the screen and/or the ambient temperature of the actuator.

The parameterization of the electronic means used for step b is independent of the adjustment used for steps a1 and a2.

The invention also relates to an actuator for winding a blackout screen around a winding shaft, this actuator comprising at least one electric motor and electronic control means for this motor. According to the invention, these electronic control means are configured to carry out the aforementioned method.

Advantageously, the motor is a synchronous permanent magnet motor.

Lastly, the invention relates to a closure or sun-shading installation incorporating, inter alia, an actuator as described above.

Figure 2:
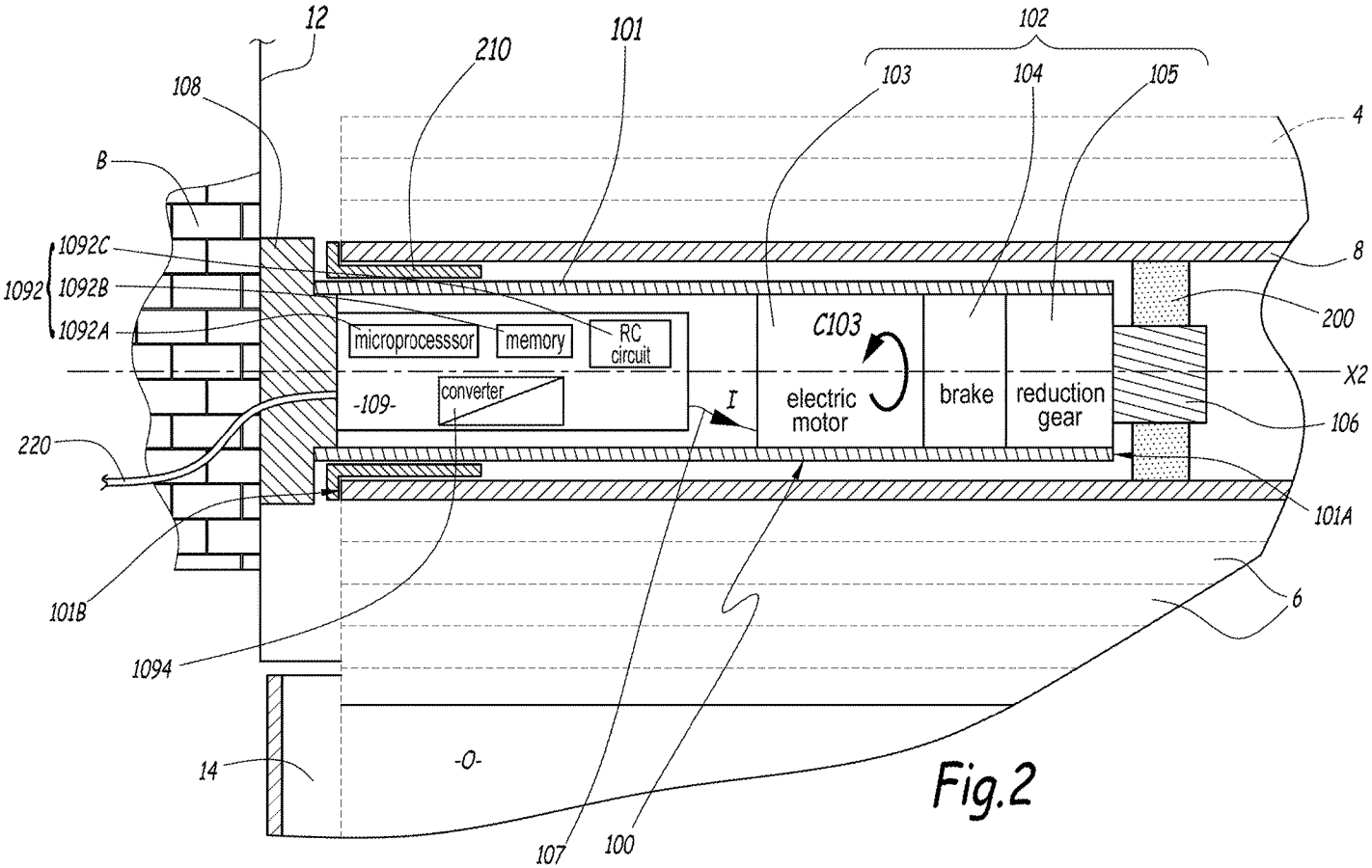
Figure 3:
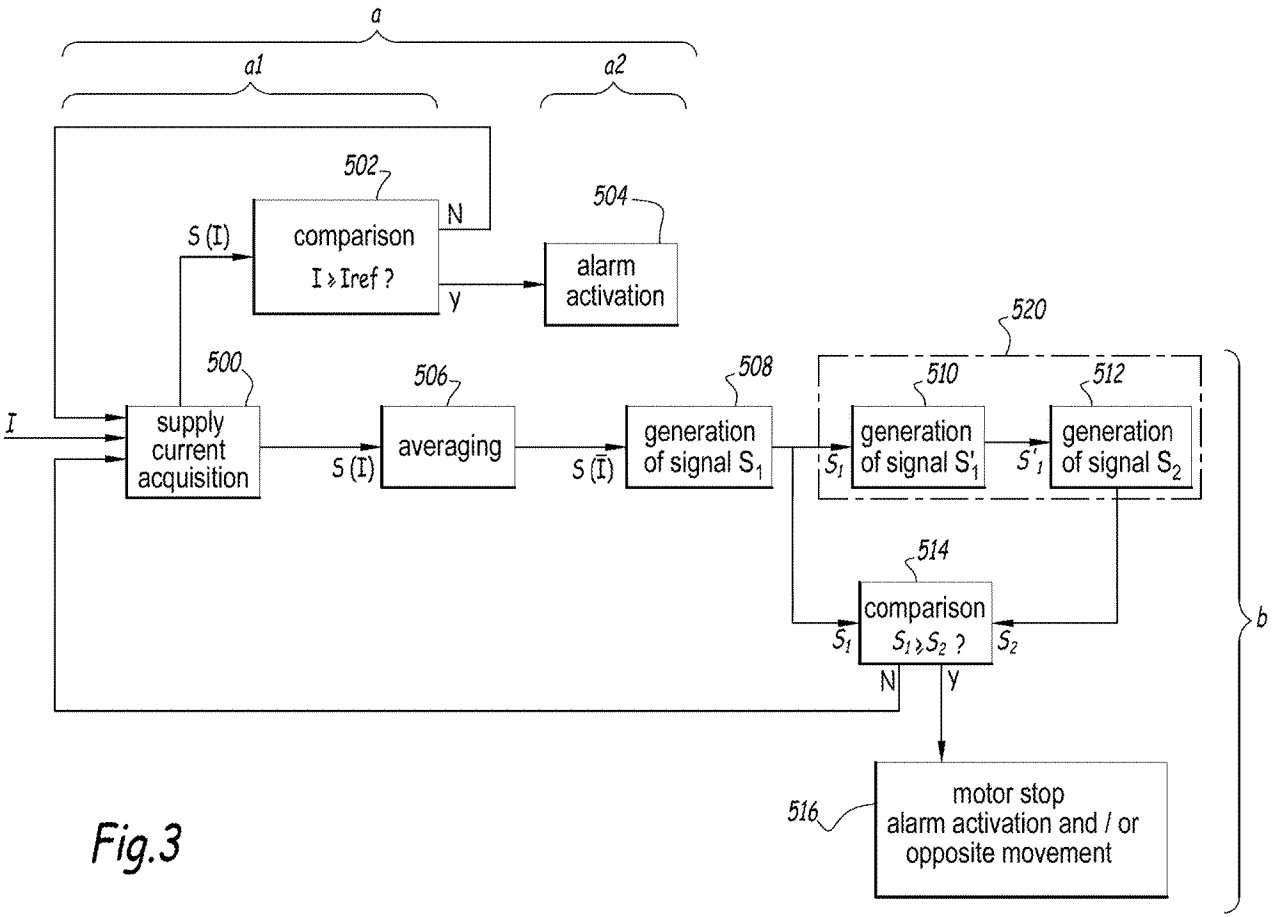
Figure 4:
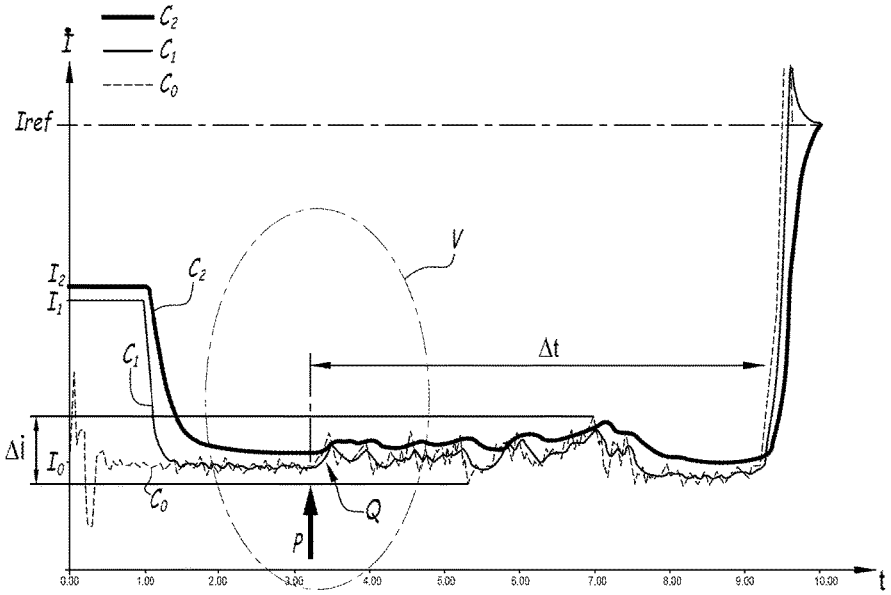
Figure 5:
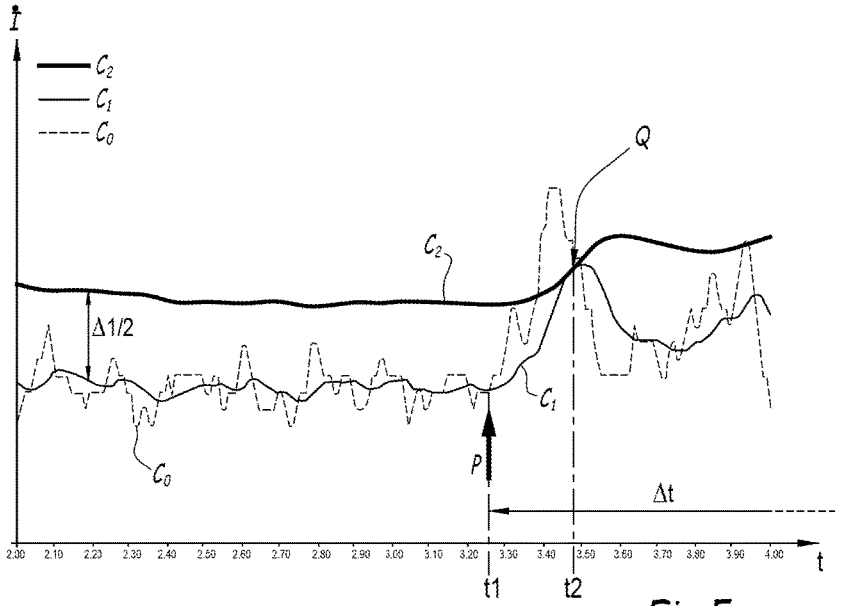

The invention will be better understood, and other advantages thereof will appear more clearly, in light of the following description of one embodiment of a method, an actuator and an installation according to its principle, provided solely as an example and done in reference to the appended drawings, in which:

FIG. 1 is a diagrammatic perspective illustration of a closure installation according to the invention incorporating an actuator according to the invention, FIG. 2 is a partial axial sectional view of the installation of FIG. 1, FIG. 3 is a block diagram of a control method according to the invention implemented in the installation of FIGS. 1 and 2, FIG. 4 is a diagrammatic depiction, as a function of time, of properties used in the method shown in FIG. 3, and FIG. 5 is a larger scale view of detail V in FIG. 4.

FIGS. 4 and 5 must be considered to simulate the operation of the actuator because they do not take into account the stopping of the actuator that may occur after carrying out step b, as shown by the explanations that follow.

The installation 2 shown in FIG. 1 comprises a screen or apron 4 formed by several slats 6 articulated relative to one another and that comprise a lower slat 62, intended to bear against the threshold of an opening O closed off by the screen 4 in the lower position, as well as an upper slat 64 attached to a winding shaft 8 using two articulations or connecting elements 10, these connecting elements being able to be rigid or flexible.

The screen 4 is made up of slats 6 fastened to one another so as to have a space between them when the screen 4 is in a suspended position, i.e., when the screen 4 is not in the lower stop position where all of the slats 6 are stacked against one another so as to be joined.

The winding shaft 8 is mounted inside a box 12, with the possibility of rotation around an axis X2, which is horizontal and stationary, and which constitutes a central axis for the installation 2.

The winding shaft 8 is rotated around the axis X2 using a tubular actuator 100, more particularly visible in FIG. 2, in which the screen 4 is shown in a partially raised position, i.e., partially wound around the winding shaft 8. The actuator 100 comprises a fixed cylindrical tube 101 in which a gear motor 102 is mounted that comprises a synchronous permanent magnet electric motor 103, in the example a brushless electronic switching motor, as well as a spring-operated brake 104 and a reduction gear 105. Reference 106 denotes the output shaft of the reduction gear 105, which protrudes at one end 101A of the fixed tube 101 and drives a wheel 200 secured in rotation with the tube of the winding shaft 8.

The winding shaft 8 rotates around the axis X2 and the fixed tube 101 owing to two pivot links, one of which is provided by a bearing ring 210 mounted near the end 101B of the fixed tube 101 opposite the end 101A. The second pivot link, which is not visible in the figures, is installed at the other end of the winding shaft 8.

The actuator 100 also comprises a fastening part or head 108, protruding at the end 101B of the tube 101 and making it possible to fasten the actuator 100 on a side wall of the box 12. This fastening part 108 also closes off the tube 101 and supports an electronic unit 109 for controlling the power supply of the motor 103. The electronic unit 109 is supplied with alternating voltage by a power cable 220 and housed in the tube 101. The electronic unit 109 also comprises a unit, not shown, for controlling the sequential power supply of the windings of the motor 103 that rectifies the power supply voltage of the motor, using a diode bridge, filters this voltage, using a capacitance, and sequentially powers each winding, using a module made up of switches.

The electronic unit 109 is provided to be in communication with a centralized controller 30 or a remote control 32. A movement control order supplied by the centralized controller 30 or the remote control 32 causes a power supply of the motor 103 making it rotate the winding shaft 8, in one direction or the other, around the axis X2, based on the user's choices. A current I circulates in an electrical conductor 107 that connects the electronic unit 109 to the motor 103 and is sequentially supplied to the different windings of the motor 103.

The installation 2 also comprises two slides 14 that extend on either side of the opening O, below the box 12, and in which the ends of the slats 6 are respectively engaged.

A device 1092 for monitoring torque, based on the stop detection function, is integrated into the electronic unit 109 and works based on the monitoring of the current I supplied to the motor 103 by the electronic unit 109. This current I is direct and developed from the alternating voltage delivered by the power cable 220. Thus, the electronic unit 109 comprises an AC/DC converter 1094. For the clarity of the drawing, the electrical connections within the electronic unit 109 are not shown in FIG. 2. This stop detection function is carried out in a first step of the method according to the invention and suitable for detecting a fast and abrupt change in the torque when, after the screen 4 reaches a stop, the screen 4 is unwound until it is constrained by the latter, thereby creating an increase in torque at the motor 103.

In practice, the device 1092 comprises a microprocessor 1092A and a memory 1092B. In practice, the memory 1092B is preferably integrated into the microprocessor 1092A. The device 1092 also comprises an RC circuit 1092C that comprises a shunting resistance through which the power supply current I of the motor 103 is measured, this shunting resistance being electrically connected to a power supply module of this motor 103 and a mass that is at a reference voltage. The current I is thus sometimes called "shunting current".

The method, shown diagrammatically in FIG. 3, comprises a first elementary step 500 during which the power supply current I of the motor 103 is acquired by the electronic unit 109. This current I constitutes an image of the torque C103 delivered by the motor 103 to the elements 104, 105 and 200, and through them, to the winding shaft 8.

In practice, the value of the current I is provided to the microprocessor 1092A in the form of an analog signal representative of the value of the current I at each moment. During step 500, this analog signal is converted by the microprocessor 1092A into a digital signal S(I).

In a second elementary step 502, the value of the digital signal S(I) is compared to a reference value Iref. The elementary steps 500 and 502 together constitute a first step a1 of the method according to the invention.

The case is considered where the actuator 100 must unwind the screen 4, i.e., drive the winding shaft 108 in a rotation direction around the axis X2 that corresponds to a lowering of the screen 4, where the lower slat 62 is moved toward the threshold of the opening O. The screen 4 normally constitutes a driving load during this lowering, inasmuch as its weight tends to rotate the winding shaft 8 in the desired rotation direction. In this case, the current I measured by the electronic unit 109 has a substantially constant value that is related to the intrinsic characteristics of the motor 103, as well as those of the spring-operated brake 104, the reducing gear 105 and the diameter of the winding shaft 8. This value is denoted $I_0$ in FIG. 4.

The current I, measured in the first elementary step 500 using the electronic unit 109, is representative of the withholding torque C103 exerted by the motor 103 on the winding shaft 8.

When the screen 4 encounters an obstacle, either inside one of the slides 14 or on the trajectory of the lower slat 62 between the slides 14, the slats 6 come closer together and settle on one another, then the screen 4 deforms locally in the box 12; the screen 4 is next compressed between the lower slat 62 blocked on the obstacle or the end of travel stop and the uppermost slat 6, which is not part of the portion of the apron 4 wound around the winding shaft 8.

In other words, when the lower slat 62 of the screen 4 abuts either on the lower end of travel or on an obstacle, the following slat 6 continues to lower until it abuts against the lower slat 62, and so forth up to a following slat 6, which may be the upper slat 64 fastened to the winding shaft 8. In this way, the screen 4 gradually becomes rigid starting from the lower slat 62 up to the winding shaft 8.

The screen 4 thus becomes a load to be driven for the actuator 100 and the torque to be exerted to continue to move the lower slat 62, or tend to move it over the lowering travel, becomes variable, then increases considerably, to the point that the value of the current I exceeds the reference value Iref.

Thus, during the second elementary step 502 of step a1, it is verified whether the value of the signal S(I) is greater than the value Iref. If this is the case, the method detects blocking of the screen 4 during its lowering and an additional step 504 is carried out, during which an audio or visual alarm is activated, while optionally, the actuator 100 is supplied with current to perform a reverse travel, raising the screen 4, with a limited amplitude in order to ease the vertical stress on the screen 4 and on the obstacle on which the lower slat 62 is bearing, before stopping the motor 103. Otherwise, i.e., if the value of the digital signal S(I) remains lower than the value Iref, the first elementary step 500 is carried out again, at the predetermined measuring frequency, i.e., 5 ms in the example.

The elementary step 504 constitutes a second step a2 of the method according to the invention that is carried out after step a1. Steps a1 and a2 are carried out to perform the stop detection function.

The case is considered where the actuator 100 must wind the screen 4, i.e., drive the winding shaft 108 in a rotation direction around the axis X2 that corresponds to a raising of the screen 4. In this case, if the screen 4 becomes jammed in one of the slides 14, the torque to be exerted to continue to move it, or tend to move it, over the raising travel, increases considerably, to the point that the value of the current I exceeds the reference value Iref. Thus, steps a1 and a2 can also be carried out over the raising of the screen 4.

Alternatively, the threshold values Iref used for the lowering and raising are different.

This stop detection function, during lowering or raising, may be deactivated or modified, based on usage conditions of the installation 2 and as shown by the following explanations.

FIG. 4 shows the case where, during the lowering of the screen 4, the latter encounters an obstacle after approximately 3 seconds after beginning its lowering movement, in practice 3.25 s as shown with point P in FIGS. 4 and 5, the screen 4 continues to unwind, then blocks and is compressed from about 9.5 s. The curve $C_0$ shows the current I as a function of time. When the obstacle blocks the downward travel of the slat 62, the screen 4 does not immediately compress. Indeed, for several seconds, between 3.25 s and about 9.5 s, in the example of FIG. 4, the actuator 100 can continue to rotate the winding shaft 8 in the direction lowering the screen 4, which corresponds to reacting the vertical play between the slats 6 of the screen 4 situated below the box 12 as well as a localized deformation of the screen 4, which tends to move radially away from the axis X2 while unwinding inside the box 12. During this transitional phase, between 3.25 s and about 9.5 s after the beginning of the movement and as shown in FIG. 4, the current I oscillates with a relatively small total amplitude $\Delta I$ around $I_0$.

Upon starting up the motor 103, the current I has major fluctuations that are not taken into account by the stop detection function, since they correspond to starting up the actuator 100. During approximately the first three seconds and after its stabilization, the current I is centered on the value $I_0$, which corresponds to the aforementioned operation under a driving load. Once an obstacle is encountered, as identified by the point P in FIGS. 4 and 5, the current I globally oscillates around the value $I_0$ with the amplitude $\Delta I$. When the winding of the screen 4 is completely blocked, the current I increases greatly and the value of the digital signal S(I) exceeds the value Iref, about 9.5 s after startup in the example of FIG. 4, which is detected in the second elementary step 502, as explained above.

The present invention makes it possible to anticipate the blocking of the screen 4 against an obstacle by adding, in addition to the stop detection function that is implemented in the first step a1, including elementary steps 500 and 502, and which detects the overtorque C103 exerted by the motor 103 based on the excess of the value Iref by the value of the digital signal S(I), a function protecting the carrier product that is implemented in a second step b and that makes it possible to react from the beginning of the oscillation phase of the current I, i.e., as soon as possible after the screen 4 has encountered an obstacle, when it is in the process of deforming locally and temporarily, while the screen 4 has just become a driven load for the actuator 100. In other words, this function of protecting the carrier product makes it possible to detect an imminent blocking of the screen 4, before this blocking actually occurs.

To that end, the control method according to the invention comprises, in addition to the elementary steps 500, 502 and 504, additional elementary steps 506 to 516 during which several operations are done by the microprocessor 1092A of the electronic unit 109. The elementary steps 506 and 516 are carried out by the same equipment as the elementary steps 500, 502 and 504, such that the function of protecting the carrier product does not cause an excess cost in terms of equipment relative to the stop detection function.

In FIG. 3, bracket a covers steps a1 and a2 belonging to the stop detection function, implemented during the first method step, while bracket b covers the steps specific to the function of protecting the carrier product, implemented during the second method step.

In practice, it is provided that elementary steps 506 to 516 of the function for protecting the carrier product are only implemented if the comparison in elementary step 502 does not make it possible to detect an overtorque C103, in other words if the value of the digital signal S(I) remains below the value Iref.

During elementary step 506, the digital signal S(I) is averaged, for example over the last twelve measured values. Thus, if the current I is measured every 5 ms, the current I at the output of step 506 is a current averaged over the previous 60 ms.

$S(\bar{I})$ denotes the averaged signal obtained at the output of elementary step 506. This signal $S(\bar{I})$ is also the input signal of the following elementary step 508.

A first digital processing operation done during elementary step 508 makes it possible to generate a first processed digital signal $S_1$.

In FIGS. 4 and 5, curve $C_1$ shows the signal $S_1$ as a function of time t. It will be noted that this curve corresponds to a fixed current value $I_1$ during approximately the first second of the lowering of the apron 4. This corresponds to the determination of a pre-established value for the signal $S_1$ during the startup of the actuator 100. The value $I_1$ is very different from the value $I_0$. In other words, the processing of elementary step 508 is neutralized, for example, during the first second after the startup of the lowering of the screen 4 and the signal $S_1$ retains the value $I_1$. This avoids an unfounded detection of an obstacle due to variations in the current I upon startup of the motor 103.

The signal $S_1$ is next processed in an additional elementary step 510 during which a second digital processing operation is applied to the signal, which becomes the signal $S'_1$ at the output of elementary step 510. During another elementary step 512, a third digital processing operation is applied to the signal $S'_1$, which then becomes a second processed digital signal $S_2$. For example, this third digital processing operation may be a shift of the signal $S'_1$ in value. Such a value shift may also constitute the first or second digital processing operation, respectively carried out in the elementary steps 508 and 510.

The first digital processing operation applied during elementary step 508 may be the application of a low-pass filter, which may have a finite or infinite impulse response, as chosen by the designer of the electronic unit 109.

The second digital processing operation applied to elementary step 510 is preferably of the same nature as that applied to elementary step 508, with other specific parameters of this processing operation by modifying time constants that may for example affect the gain or the characteristic frequencies used.

During an elementary step 514, the first and second digital signals $S_1$ and $S_2$ are compared in order to establish whether the actuator 100 is in a situation such that the screen 4 having encountered an obstacle is in the process of locally deforming below and/or inside the box 12, for example because it is unwinding abnormally in the box 12, before the unwinding is completely blocked. This situation takes place in the example over a period of time Δt, which extends between 3.25 s and about 9.5 s in FIG. 4. In other words, the comparison of elementary step 514 makes it possible to detect whether the screen 4 is in the process of locally deforming, while generating relatively low amplitude current variations, before being completely blocked and compressed against the obstacle, from about 9.5 s.

In FIGS. 4 and 5, curve $C_2$ shows the signal $S_2$ as a function of time t.

Upon startup, i.e., during the first second, the value of the digital signal $S_2$ is set at a value $I_2$ greater than the value $I_1$ and very different from the value $I_0$, for the same reasons as explained above for the digital signal $S_1$.

It is considered that the apron 4 encounters an obstacle at a moment $t_1$=3.25 s after the beginning of its lowering, which represents the point P in FIGS. 4 and 5. The digital signal $S_1$ can be a smoothed version of the signal S(I), due to the digital processing applied in elementary step 508. Based on the digital processing operations respectively applied in elementary steps 508, 510 and 512, it is possible to dynamically determine that an obstacle has been encountered, that the screen 4 is unwinding abnormally in the box 12 and that imminent blocking of the screen 4 should be anticipated through the comparison of the first and second digital signals $S_1$ and $S_2$. In this example, imminent blocking of the screen 4 is determined when the first digital signal $S_1$, which is an image of the current I at that moment, assumes a value greater than or equal to the second digital signal $S_2$, which takes place from a moment $t_2$ identified by point Q in FIGS. 4 and 5. In another example, according to the digital processing operations applied to the signals during elementary steps 508, 510 and/or 512, the imminent blocking of the screen 4 is determined when the second digital signal $S_2$ assumes a value greater than or equal to the first digital signal $S_1$. According to another example, the imminent blocking of the screen 4 is determined when the shift Δ½ between the instantaneous values of the first and second digital signals S1, S2 is above a predefined threshold.

When imminent blocking of the screen 4 is determined, an elementary step 516 is carried out during which the motor 103 is stopped, an alarm is activated and/or a movement of the actuator 100 in the opposite direction is initiated, then the motor 103 is stopped, using an approach similar to that mentioned above regarding elementary step 504. In practice, elementary step 516 can be identical to elementary step 504.

In the example of FIG. 4, the moment $t_2$ is at 3.47 s after the beginning of the lowering of the screen 4, or 0.22 s after the obstacle has been encountered by the screen 4 at moment $t_1$. Thus, the function of protecting the carrier product in step b makes it possible to obtain a reaction time, in case of obstacle over the course of the lowering, of 0.2 s, while this reaction time is about 6 s, or between 3.25 s and about 9.5 s, with the stop detection function of steps a1 and a2. The reactivity of the control means of the actuator 100, i.e., of the electronic unit 109, is therefore improved by the function of protecting the carrier product of the invention.

The stop detection function cannot, however, be replaced by the function of protecting the carrier product because the former acts as a safety function, necessary in certain usage scenarios, for example when stopped on the lower stop, where the unwinding of the screen 4 in the box 12 is very limited. Furthermore, the detection sensitivity and the reactivity of the function of protecting the carrier product risk causing false detections, which is not the case for the stop detection function. They are both therefore highly complementary.

Once elementary step 516 has been carried out, imminent blocking of the screen 4 is anticipated, even if the comparison between the signal $S_1$ and the signal $S_2$ again provides another result. In this sense, the curves $C_0$, $C_1$ and $C_2$ in FIGS. 4 and 5 are theoretical because, due to step 516, the current I has a zero value shortly after the moment $t_2$, in reaction to the imminence of blocking. These curves show what could occur if the function of protecting the carrier product was not implemented.

In the case where the comparison between the signals $S_1$ and $S_2$ does not provide any indication of immediate blocking of the screen 4, elementary step 500 is implemented again, at the predetermined measuring frequency.

Elementary steps 510 and 512 constitute a group of elementary steps 520 during which a sort of template or dynamic model is created formed by the digital signal $S_2$ and represented by the curve $C_2$, which the digital signal $S_1$, which substantially corresponds to the shunting current I after digital processing, is compared to the predetermined measuring frequency. This template or dynamic model $S_2$ corresponds to a value digitally processed from the digital signal $S_1$.

The invention makes it possible to take into account current variations with a relatively low intensity, $\Delta I$, around the value $I_0$, after a startup period of about 1 s, to anticipate a blocking risk of the screen 4, before the latter actually becomes a driven load. In other words, the invention, which is based on the detection of a deformation phenomenon of the screen 4 that takes place during the period $\Delta t$ shown in FIG. 4, makes it possible to use this period to react, if applicable using elementary step 516, before the output torque C103 delivered by the motor 103 increases considerably, to the point that the value of the digital signal S(I) reaches or exceeds the value Iref, as shown in FIG. 4.

In another embodiment, it is also possible to use the information provided by the function of protecting the carrier product to adjust the detection threshold of the stop detection function. The function of protecting the carrier product then corresponds to a function for anticipating a torque peak.

It will be noted that the same current I is used, from elementary step 500, both in elementary steps 502 and 504, in the context of the stop detection function, to detect the torque C103 exerted by the motor 103 on the winding shaft 8, and in elementary steps 506 to 516 as part of the function of protecting the carrier product, to detect the deformation phenomenon of the screen 4.

Elementary steps 506 to 516 are carried out by the electronic unit 109 like elementary steps 502 and 504, such that the detection of a deformation phenomenon of the screen 4 is obtained without it being necessary to add control members in the actuator 100. In other words, the additional detection, which makes it possible to anticipate a blocking situation of the screen 4 owing to elementary steps 506 to 516, is based on calculations that, in practice, do not require adding electronic components in the electronic unit 109, which traditionally comprises the microprocessor 1092A and, most often, one or several data storage memories, such as the memory 1092B.

Since elementary steps 506 to 516 are carried out in the electronic unit 109, it is possible to configure these steps by varying the digital values used by the microprocessor 1092A for elementary steps 508, 510 and 512. For example, depending on the digital processing operations applied in elementary steps 508 and 510, it is possible to vary a cutoff frequency of a filter, characteristic frequencies or gains. Regarding elementary step 512, the value of the shift may also be adjusted. These adjustments may be done by programming the electronic unit 109 using the centralized controller 30, the remote control 32 or a computer temporarily connected to the electronic unit 109 during commissioning of the installation 2.

The parameterizable nature of the electronic unit 109 makes it possible to take data into account specific to the installation 2, such as the weight or size of the screen 4 or the diameter of the winding shaft 8. The parameterizable nature of the electronic unit 109 also makes it possible to take account of the "quality" of the slides 14, i.e., their truly straight and vertical nature and their inner surface condition, which may be related to whether the installation 2 is new or older. The parameterizable nature of the electronic unit 109 also makes it possible to take account of the ambient temperature, which may affect the behavior of the screen 4, in particular, in case of negative temperature, the sliding of the ends of the slats 6 in the slides 14 may have hard spots related to frost that may form, without any additional temperature measurement.

Thus, to carry out the method according to the invention, one begins by configuring the electronic unit 109, i.e., setting or adjusting its operating parameters, based on the sensitivity level selected for the detecting the deformation of the screen 4 and/or the ambient temperature. This parameterization or this adjustment may be done by selecting certain values in the memory 1092B or entering values in said memory.

The parameterizable nature of the electronic unit 109 even makes it possible to deactivate the part of the method corresponding to the function of protecting the carrier product and based on detecting the deformation phenomenon of the screen 4, by choosing, for elementary steps 508, 510 and 512, parameters such that the signal $S_1$ remains strictly lower than the signal $S_2$ at all times. This may be the case for an installation 2 whereof the slides 14 are very damaged or that is working under extreme temperature or load conditions, in which case the function of protecting the carrier product is not appropriate, since it would cause false detections.

The function of protecting the carrier product may also be deactivated if hard spots upon lowering in the slides 14 are numerous and/or major, since the mechanics of the carrier product are not suitable, in particular following excessive aging of the carrier product, or during the renovation of an installation, during which the rolling shutter is modified by going from manual driving by a strap to motorized driving, or an incompatible change in motor means.

In summary, the function of protecting the carrier product can be deactivated to operate actuators mounted in installations not appropriate for that solution, in particular, in terms of quality of the slides 14 or operating conditions.

Deactivating the function of protecting the carrier product or adjusting the sensitivity of the function of protecting the carrier product based on the ambient temperature measured at the actuator 100 makes it possible to prevent the detection of blocking of the screen 4 from being too sensitive.

This deactivation or adjustment therefore makes it possible to obtain the robustness of the function of protecting the carrier product from untimely activations, under low temperature conditions where the slats of the screen 4 may be frozen, the slides 14 hindered by frost or the resisting torque greater within the gear motor 102.

Deactivating or adjusting the sensitivity of the function of protecting the carrier product may be done at the installer's initiative, which allows the latter to take account of the actual implementation conditions of the installation 2, in particular when the apron 4 or its actuator 100 are damaged or mounted imperfectly.

The independent nature of elementary steps 502 and 514 allows an independent adjustment of the detection sensitivity of the torque C103 exerted by the motor 103, corresponding to the stop detection function, and on the other hand the detection of the deformation phenomenon of the screen 4 corresponding to the function of protecting the carrier product. Indeed, the reference value Iref may be determined independently of the parameters used in elementary steps 508, 510 and 512.

The invention is shown in FIG. 3 in the case where the digital signal S(I) used in elementary step 502 is from elementary step 506. Alternatively, the signal used in elementary step 502 may be the signal $S(\bar{I})$ from elementary step 500 or the signal $S_1$ from elementary step 508. In this case, the signal used in elementary step 502 is averaged and optionally digitally processed, while remaining representative of the output torque C103 of the motor 103. In this case, elementary step 506, and optionally elementary step 508, belong to step a1.

Elementary step 506 is optional. It may be omitted or integrated into elementary step 508.

The invention is shown in FIGS. 1 and 2 in the case of its use with a screen 4 of rolling shutter formed by several slats 6. It is, however, applicable to other types of blackout screens, whether involving closure or sun-shading screens. However, the invention is particularly advantageous when the screen is a screen with slats or open-worked members made up of elements articulated to one another with a possibility of relative movements, such as slats or links of a gate, since the relative movements of these parts of the screen over the period Δt generate current variations like those shown over this period in FIG. 4.

The numerical values, in particular the durations, mentioned in this description are indicative and in practice depend on the installation conditions of the actuator 100.

The embodiments and alternatives considered above may be combined to generate new embodiments of the invention, without going beyond the scope of the invention defined by the claims.

The invention claimed is:

1. A method for controlling an actuator for winding a blackout screen around a winding shaft mounted within a box and allowing rotation of the blackout screen around a rotation axis, the actuator comprising at least one electric motor, the method comprising at least the following steps:

a1) with an electronic control means, that comprises a microprocessor, a memory, and a shunting resistance and that provides power supply current to the actuator, detecting blocking of the screen during lowering or raising of the screen wound around the winding shaft, by the electronic control means measuring the power supply current provided from the electronic control means to the motor during the lowering or raising of the screen, the electronic control means using the measured power supply current to determine a torque exerted by the motor on the winding shaft during the lowering or raising of the screen, the electronic control means providing a signal representative of the measured power supply current and the current having a substantially constant value ($I_0$) during lowering of the blackout screen;

a2) the electronic control means stopping the motor when the signal representative of the measured power supply current is above a threshold current value;

b) after a startup period and when the signal representative of the measured power supply current is below the threshold current value, the electronic control means detecting a localized deformation of the screen which tends to move radially away from the rotation axis while unwinding inside the box, during lowering, based on the measured power supply current, the detection occurring via a determination of a current oscillation around the substantially constant value ($I_0$); and c) the electronic control means are adjusted, based on a sensitivity level selected for the detecting the localized deformation of the screen, by selecting certain values in the memory or entering values in the memory.

2. The method according to claim 1, wherein step b comprises at least steps of:

b1) using the microprocessor of the electronic control means to create a first digital signal, by applying first digital processing to the signal representative of the measured power supply current of the motor, b2) using the microprocessor of the electronic control means to create a second digital signal by applying at least one second digital processing operation to the first digital signal, b3) with the microprocessor of the electronic control means, comparing the first digital signal to the second digital signal, and b4) with the microprocessor of the electronic control means, establishing whether blocking of the screen is imminent, based on the result of the comparison of elementary step b3.

3. The method according to claim 2, wherein the second digital signal is created by the microprocessor of the electronic control means applying value shift processing to the first digital signal, in addition to the second digital processing operation.

4. The method according to claim 2, wherein the electronic control means comprises a low-pass filter and at least one of the first digital processing operation and the second digital processing operation use the low-pass filter.

5. The method according to claim 2, wherein the electronic control means comprises a low-pass filter and the first digital processing operation and the second digital processing operation use the low-pass filter.

6. The method according to claim 2, wherein the signal representative of the measured power supply current represents an instantaneous value of the measured power supply current and, during elementary step b4, blocking of the screen is considered to be imminent when the first digital signal is greater than the second digital signal.

7. The method according to claim 2, wherein the signal representative of the measured power supply current represents an instantaneous value of the measured power supply current and, during elementary step b4, blocking of the screen is considered to be imminent when the difference between the first digital signal and the second digital signal is above a predefined threshold.

8. The method according to claim 1, further comprising a prior step c of at least one of:

determining a sensitivity level for the electronic control means detecting imminent blocking of the screen, and storing ambient temperature of the actuator in the memory of the electronic control means.

9. The method according to claim 8, wherein step b is independent of step c).

10. The method according to claim 1, wherein, the screen is comprised of plural slats articulated relative to one another, including a lower slat and an upper slat attached to the winding shaft, the slats being fastened to one another in a suspended position above a lower stop position where, in the lower stop position, all of the slats are stacked, and the slats encountering an obstacle blocking travel of the screen, causes the slats to undergo the localized deformation by the slats coming closer together and settling on one another.

11. An actuator and blackout screen assembly, comprising:

a winding shaft mounted within a box and allowing rotation around a rotation axis;

a screen comprised of plural slats articulated relative to one another, the slats including a lower slat and an upper slat attached to the winding shaft, the screen being wound around the winding shaft, wherein when lowering the screen to a lower stop position, the slats are fastened to one another in a suspended position above the lower stop position, wherein in the lower stop position, all of the slats are stacked, wherein during lowering of the screen, when the slats encounter an obstacle blocking travel of the screen, the slats to undergo the localized deformation;

an actuator located within the winding shaft, the actuator operative for winding a blackout screen around the winding shaft, the actuator comprising at least one electric motor and an electronic control means connected to supply power to the motor, wherein the electronic control means comprises a microprocessor, a memory connected to the microprocessor, and a shunting resistance and the electronic control means are configured to a1) provide a power supply current to the actuator during lowering or raising of the screen, detect blocking of the screen during the lowering or raising of the screen by the electronic control means measuring the power supply current provided from the electronic control means to the motor during the lowering or raising of the screen, the electronic control means using the measured power supply current to determine a torque exerted by the motor on the winding shaft during the lowering or raising of the screen, the electronic control means providing a signal representative of the measured power supply current and the current having a substantially constant value ($I_0$) during lowering of the blackout screen, a2) stop the motor when the signal representative of the measured power supply current is above a threshold current value, b) after a startup period and when the signal representative of the measured power supply current is below the threshold current value, detect a localized deformation of the screen which tends to move radially away from the rotation axis while unwinding inside the box, during lowering, based on the measured power supply current, the detection occurring via a determination of a current oscillation around the substantially constant value ($I_0$), and c) adjust the electronic control means, based on a sensitivity level selected for the detecting the localized deformation of the screen, by selecting certain values in the memory or entering values in the memory.

12. The assembly according to claim 11, wherein the electric motor is a synchronous permanent magnet motor.

13. The assembly according to claim 11, wherein, the electronic control means is located within the winding shaft and further comprises an AC/DC converter connected to the microprocessor and connected to supply the power supply current, under control of the microprocessor, to the electric motor, and an RC circuit connected to the microprocessor and connected to measure the power supply current supplied from the AC/DC converter to the electric motor, and the slats encountering an obstacle blocking travel of the screen, causes the slats to undergo the localized deformation by the slats coming closer together and settling on one another.

* * * * *